US009968174B2

(12) United States Patent
Seo

(10) Patent No.: US 9,968,174 B2
(45) Date of Patent: May 15, 2018

(54) ANTIMICROBIAL COSMETIC CONTAINER CONTAINING IMPREGNATING MATERIAL

(71) Applicant: DMT Co., Ltd., Incheon (KR)

(72) Inventor: Youn Oug Seo, Incheon (KR)

(73) Assignee: DMT CO. LTD., Incheon (KR)

( * ) Notice: Subject to any disclaimer, the term of this patent is extended or adjusted under 35 U.S.C. 154(b) by 132 days.

(21) Appl. No.: 15/058,451

(22) Filed: Mar. 2, 2016

(65) Prior Publication Data

US 2016/0255939 A1 Sep. 8, 2016

(30) Foreign Application Priority Data

Mar. 2, 2015 (KR) ..... 10-2015-0029186

(51) Int. Cl.

| | |
|---|---|
| ***A45D 33/00*** | (2006.01) |
| ***A45D 37/00*** | (2006.01) |
| ***A45D 34/00*** | (2006.01) |
| ***A45D 40/22*** | (2006.01) |
| ***A45D 33/24*** | (2006.01) |

(52) U.S. Cl.

CPC ..... *A45D 33/006* (2013.01); *A45D 33/24* (2013.01); *A45D 34/00* (2013.01); *A45D 37/00* (2013.01); *A45D 40/22* (2013.01); *A45D 2200/1036* (2013.01)

(58) Field of Classification Search

CPC ..... A45D 33/00; A45D 33/006; A45D 33/24; A45D 37/00

See application file for complete search history.

(56) References Cited

U.S. PATENT DOCUMENTS

2011/0130523 A1* 6/2011 Mukai ..... C08J 3/12 525/418
2012/0180808 A1* 7/2012 Nakamura ..... A45D 33/006 132/320
2014/0021654 A1* 1/2014 Martins ..... B29C 59/16 264/400

OTHER PUBLICATIONS

Daicel Product Data Sheet. Obtained Aug. 31, 2017 at https://www.daicel.com/yuuki/en/product/index.php?page=1&act=detail&cid=23&id=175.*

* cited by examiner

*Primary Examiner* — Arrie L Reuther
(74) *Attorney, Agent, or Firm* — Weiss & Moy, P.C.; Jeffrey D. Moy

(57) ABSTRACT

Provided is a cosmetic container containing an antimicrobial impregnating material made of a polycaprolactone polyol foam in an antimicrobial sealed container, and more particularly, an antimicrobial cosmetic container containing an antimicrobial material which may reinforce disadvantages of polyester polyol foam- and polyether polyol foam-type impregnating materials, such as water resistance (hydrolysis resistance) and oil resistance and inhibit the proliferation of microorganisms.

3 Claims, 5 Drawing Sheets

ANTIMICROBIAL COSMETIC CONTAINER CONTAINING IMPREGNATING MATERIAL

CROSS-REFERENCE TO RELATED APPLICATION

This application claims priority to and the benefit of Korean Patent Application No. 2015-0029186, filed on Mar. 2, 2015, the disclosure of which is incorporated herein by reference in its entirety.

BACKGROUND

1. Field of the Invention

The present invention relates to a cosmetic container with an antimicrobial sealing ability, which contains an antimicrobial impregnating material consisting of a polycaprolactone polyol foam, which is developed to improve disadvantages of a polyester polyol foam and a polyether polyol foam, for example, water resistance and oil resistance and to inhibit the proliferation of microorganisms.

2. Discussion of Related Art

Generally, a cushion pact is a cosmetic product for base makeup for the face, which has a natural beige color, and contains a cosmetic mainly manufactured in a solution (liquid).

As the cushion pact, a dual container-type cushion pact, which includes an impregnating material for impregnating a cosmetic, a refillable inner container containing the cosmetic and the impregnating material, and an outer container coupling to the refillable inner container to accommodate, is used.

The above-described cushion pact is portable because the cosmetic is impregnated in the impregnating material, and is convenient because it is designed to apply an appropriate amount of the cosmetic to the face using a puff, not a hand.

Conventional impregnating materials may be classified into polyether polyol foams and polyester polyol foams depending on a raw material. The polyether polyol foams have excellent elasticity, low hydrolytic degradation, and low costs, but have low oil resistance. Also, the polyester polyol foams have a large amount of polar carbonyl groups or hydrogen bonds, thereby facilitating bubble adjustment, and have an excellent advantage such as a mechanical property or drug resistance. However, the polyester polyol foams are easily hydrolyzed, and cracked when stored at high temperature for a long period.

Since the impregnating material for impregnating the cosmetic is in contact with the puff to apply the cosmetic to the face, it is easily contaminated with microorganisms. The face provides good conditions for proliferating microorganisms due to sebum and sweat secreted from the skin, dusts in the air, or a behavior of touching the face with a hand contaminated with microorganisms. As the cosmetic is applied to the face with the puff, the microorganisms may be transferred to the puff, and the puff also has a good environment for proliferating microorganisms due to moisture and nutrients provided by the cosmetic and a heat-insulating property of the container. Since the cosmetic is a liquid containing water, the pact container composed of an outer container and an inner container (a refillable container) has a good temperature environment for proliferating microorganisms due to a heat-insulating property.

Also, since the puff contaminated with microorganisms is put on an upper part of the refillable inner container, and the impregnating material contaminated with microorganisms due to the use of the puff is contained in a lower part of the inner container, it is necessary to develop an antimicrobial refillable container capable of inhibiting the proliferation of microorganisms.

SUMMARY OF THE INVENTION

The present invention is directed to providing a cosmetic container, which includes an impregnating material containing an antimicrobial silver glass component, to improve a phenomenon of cracking a polyester polyol foam by hydrolysis and a lower oil resistance of a polyether polyol foam than the polyester polyol foam and to inhibit the proliferation of microorganisms, and an antimicrobial container capable of inhibiting the proliferation of microorganisms, which may be contaminated by a puff.

To achieve the purpose of the present invention, the present invention provides a cosmetic container, which includes an outer container; an inner container accommodated in the outer container; and an impregnating material accommodated in the inner container and consisting of a polycaprolactone polyol foam made of a compound represented by Formula 1.

[Formula 1]

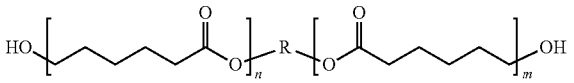

In Formula 1, R is an alkylene or arylene group having 1 to 30 carbon atoms, and n and m are each independently an integer from 1 to 1000.

In the present invention, the compound represented by Formula 1 may have a molecular weight of 1000±100, a melting point of 30 to 40° C., a density of 1.05±0.1 g/cm$^3$, and a viscosity of 150±10 mPa·s.

In the present invention, the impregnating material may have an open cell structure, and a density of 1.05±0.1 g/cm$^3$, a pore number of 80 to 100 pores per inch (ppi), and a hardness of 40 to 50.

In the present invention, at least one of the inner container (upper and lower parts) and the impregnating material may contain an antimicrobial silver glass component.

In the present invention, the antimicrobial component may be silver glass containing 1 to 3 wt % of silver, the inner container (upper and lower parts) may contain 1 to 3 wt % of silver glass, and the impregnating material may contain 0.1 to 2 wt % of silver glass.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, the present invention will be described in detail.

Figure 1:
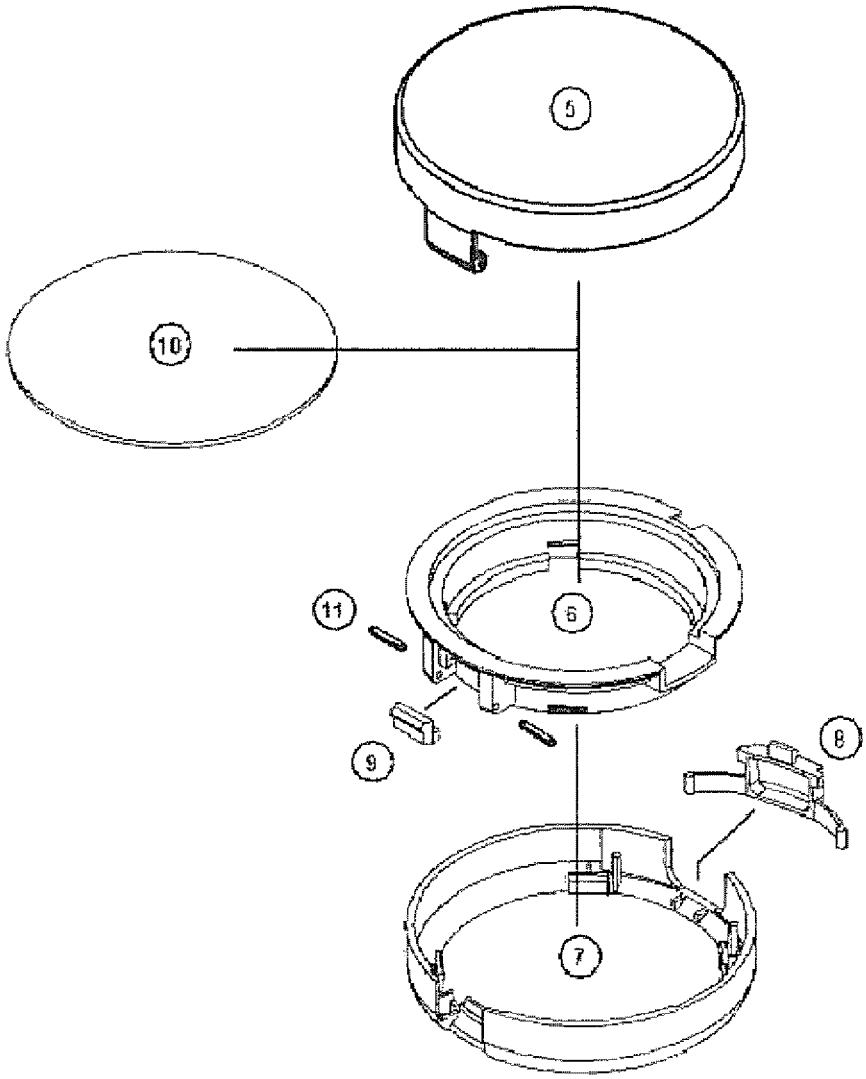
FIG. 1 is an exploded perspective view of an outer container of a cosmetic container according to the present invention.
Figure 2:
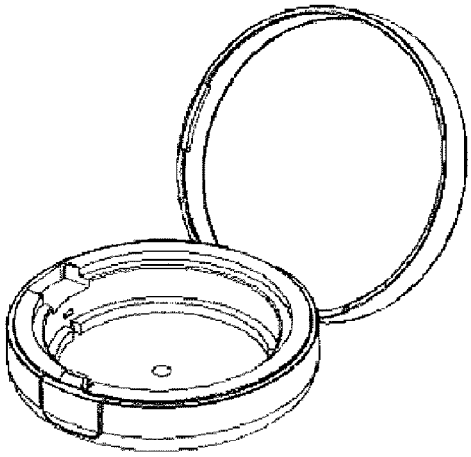
FIG. 2 is an exploded perspective view of the outer container assembled according to FIG. 1.

FIG. 1 is an exploded perspective view of an outer container of a cosmetic container according to the present invention, and FIG. 2 is an exploded perspective view of the outer container assembled according to FIG. 1, wherein the outer container may be composed of an upper part of the outer container 5, a middle part of the outer container 6, a lower part of the outer container 7, a button 8, a tension 9, a mirror 10, and a pin 11. The upper part of the outer container 5, the middle part of the outer container 6 and the lower part of the outer container 7 are rotatably and openably coupled by the pin 11, and the button 8 and the tension 9 are kinds of fastening devices for opening and closing the outer container. The upper part of the outer container 5, the middle part of the outer container 6 and the lower part of the outer container 7 may consist of acrylonitrile butadiene styrene (ABS), the button 8 may consist of polyacetal (POM) and polycarbonate (PC), the tension 9 may consist of silicone, the mirror 10 may consist of a glass, and the pin 11 may consist of stainless steel (SUS).

Figure 3:
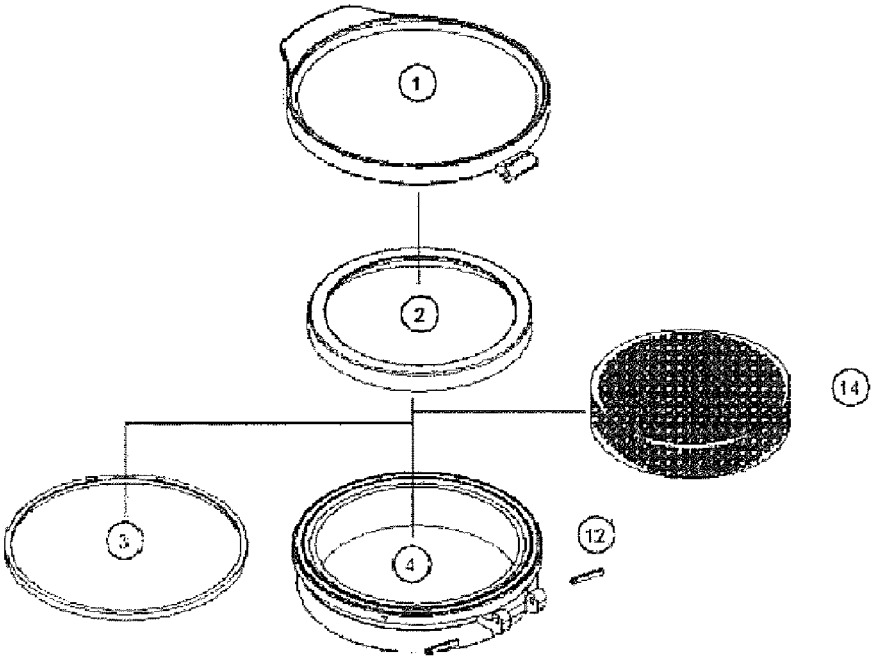
FIG. 3 is an exploded perspective view of an inner container of the cosmetic container according to the present invention.
Figure 4:
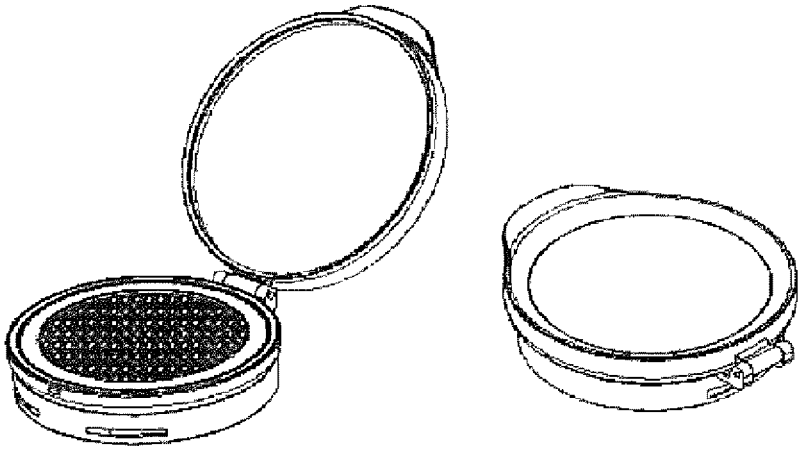
FIG. 4 is an exploded perspective view of the inner container assembled according to FIG. 3.

FIG. 3 is an exploded perspective view of an inner container of the cosmetic container according to the present invention, and FIG. 4 is an exploded perspective view of the inner container assembled according to FIG. 3, wherein the inner container may be composed of an upper part of the inner container 1, a ring 2, an inner container packing 3, a lower part of the inner container 4, and a pin 12. The upper part of the inner container 1 and the lower part of the inner container 4 are rotatably and openably coupled by the pin 12. A cosmetic-impregnated impregnating material 14 may be contained in the lower part of the inner container 4, and a puff for applying the cosmetic to the face may be put on the upper part of the inner container 1, which is a lid. The upper part of the inner container 1, the ring 2 and the lower part of the inner container 4 may consist of polypropylene (PP), the packing 3 may consist of santoprene, and the pin 12 may consist of SUS.

Figure 5:
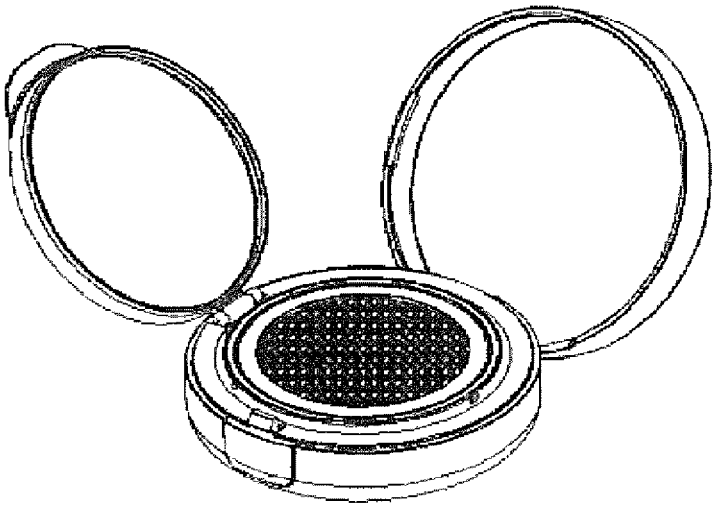
FIG. 5 is a perspective view of the cosmetic container according to the present invention.
Figure 6:
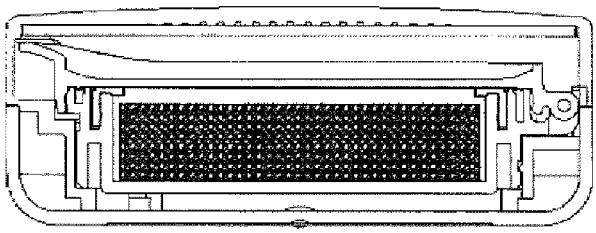
FIG. 6 is a cross-sectional view of the cosmetic container according to the present invention.

FIG. 5 is a perspective view of the cosmetic container in the form of a cushion pact according to the present invention, and FIG. 6 is a cross-sectional view thereof. The cosmetic container according to the present invention may be composed of an outer container, an inner container accommodated in the outer container, and an impregnating material contained in the inner container. The inner container is a refillable container, which has a replaceable structure that can be detached from the outer container. A material for the containers can be, other than the above-described materials, composite PP, polyethylene (PE), high density polyethylene (HDPE), polyethyleneterephthalate (PET), or styrene acrylonitrile copolymer (SAN). Particularly, the lower part of the inner container among the containers may have a sealed packing structure.

In a method of manufacturing the container, for example, the outer container (general injection) may be manufactured by injecting 3 wt % of a color masterbatch and 97 wt % of ABS using an injection machine. The upper part of the inner container (general injection) may be manufactured by injecting 3 wt % of a color masterbatch, 20 wt % of an antimicrobial masterbatch, and 77 wt % of PP using an injection machine. The lower part of the inner container may be manufactured by double injection, in which 3 wt % of a color masterbatch, 20 wt % of an antimicrobial masterbatch, and 77 wt % of PP are used in the first injection, and santoprene (Thermoplastic Elastomers (TPEs)) is used in the second injection.

The impregnating material according to the present invention may consist of a polycaprolactone polyol foam made of a compound represented by Formula 1.

[Formula 1]

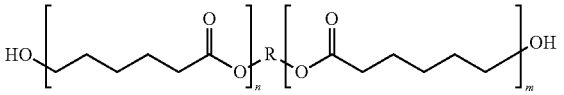

In Formula 1, R is an alkylene or arylene group having 1 to 30 carbon atoms, and n and in may be each independently an integer from 1 to 1000. Preferably, R has 5 or more carbon atoms.

The compound represented by Formula 1 may have a molecular weight (Mw) of 1000±100, and an external phase of a solid (wax). The compound is white, odorless and neutral in pH, and may have a melting point of 30 to 40° C., a density (at 40° C.) of 1.05±0.1 g/cm$^3$, and a viscosity (at 60° C.) of 150±10 mPa·s.

In the present invention, as the impregnating material, a polycaprolactone polyol foam is used. A composition of the impregnated cosmetic consists of 15 to 55 wt % of an oil phase and 20 to 50 wt % of a water phase, and has both properties between oil and water. Therefore, to compensate a phenomenon of cracking a polyester polyol foam due to hydrolysis and a lower oil resistance of a polyether polyol foam than the polyester polyol foam, the present invention uses a polycaprolactone polyol foam having excellent water resistance and oil resistance as the impregnating material.

The impregnating material according to the present invention may be a foam having an open cell structure, and have a density (at 40° C.) of 1.05±0.1 g/cm$^3$, a pore number of 80 to 100 ppi, and a hardness of 40 to 50 based on the Asker hardness. When the impregnating material has a closed cell structure, bubbles are enclosed in the impregnating material and thus a low viscosity emulsifying content may not be impregnated in the impregnating material. For this reason, the open cell structure is preferable for the impregnating material. When the density of the impregnating material is too low, the cosmetic composition is too much put on a puff, which is inconvenient, and when the density of the impregnating material is too high, due to the lack of pores in which the content can be impregnated, it has difficulty in effective impregnating of the content. When the pore number of the impregnating material is too small, elasticity of the impregnating material is decreased and thus usability of the pact may be degraded, and when the pore number of the impregnating material is too large, durability in use may be degraded. When the hardness of the impregnating material is too low, the cosmetic composition impregnated in the impregnating material may be too much put on an applicator (a puff) or a hand in use of a pact-type product, and when the hardness of the impregnating material is too high, the cosmetic composition is rarely put on an applicator or hand.

Table 1 shows the comparative physical properties between the foam of the present invention and the conventional foams. The physical properties were evaluated as very good (++); good (+); acceptable (o); poor (−); and very poor (−−). It can be confirmed that the physical properties of the polycaprolactone polyol foam used in the present invention are better than those of the conventional polyester polyol foam and polyether polyol foam.

TABLE 1

| Physical properties | Polyester polyol foam | Polycaprolactone polyol foam | Polyether polyol foam |
|---|---|---|---|
| Hydrolysis resistance (Water resistance) | −− | + | ++ |
| Thermal oxidation resistance | + | + | − |
| Low temperature flexibility | o | + | ++ |
| Mechanical property | ++ | ++ | + |
| Oil resistance | ++ | + | − |
| Injectability (workability) | + | ++ | o |

1) Hydrolysis Resistance (Water Resistance)

It has been known that an ether group has a much higher hydrolysis resistance than an ester group. Hydrolysis of the ester group follows a triple mechanism, resulting in an acid and a base. Since a free acid is isolated by hydrolysis of an ester bond, this reaction is defined as an automatic catalysis. Therefore, polyether has a higher hydrolysis resistance than polyester and polycaprolactone.

It is also known that polycaprolactone has a higher hydrolysis resistance than polyester. This is caused by the fact that stability of the ester bond is increased as a hydrocarbon length is increased. The polycaprolactone has five —$CH_2$— groups between two ester bonds, but the polyester has only four —$CH_2$— groups.

2) Thermal Oxidation Resistance

Oxidation generally generates a radical by attacking a hydrocarbon chain, and during the oxidation, several reactions occur until the chain breaks (general oxidation mechanism). As the hydrocarbon chain has more and more unstable hydrogen atoms, thermal oxidation stability of the polymer is much degraded.

In the case of ether, hydrogen binding to carbon adjacent to oxygen is more easily oxidized, and thus easily generates a peroxide.

3) Polyurethane Structure

Since a cured part has high polarity, as the polarity of a long chain diol is lower, polyurethane is more phase-separated. When long chain diols having the same molecular weight are used, the polyether is more phase-separated than the polycaprolactone and the polyester.

This is because the polyether has the lowest Tg, and the polyether is more flexible at low temperature. However, the polyester has the lowest flexibility at low temperature because it has the highest Tg.

Meanwhile, the polyether has a larger cured part and thus has a higher crystallinity and a higher melting point. Since the polycaprolactone also has a higher crystallinity than the polyester, a recrystallization velocity is higher than the polyester. Therefore, the polycaprolactone is very suitable for injection molding (workability). For this reason, the polycaprolactone has a higher adhesive strength to a substrate than the polyester.

The polyether has a poorer mechanical property, but a higher elasticity than the polycaprolactone and the polyester.

4) Oil Resistance (Oil, Grease and Solvent Resistance)

In contrast with the hydrolysis resistance (water resistance), the polyester has a higher polarity and thus has the highest oil resistance, and the polyether has the lowest oil resistance.

Materials for the impregnating material may include an isocyanate compound, a foaming agent, a catalyst, a foam stabilizer, and an antimicrobial material, in addition to the polycaprolactone polyol of Formula 1.

The polycaprolactone polyol may react with the isocyanate compound, thereby forming a foam. A content of the polycaprolactone polyol may be 50 to 80 wt % with respect to a total weight of the raw material.

The isocyanate compound may be classified into an aromatic isocyanate and an aliphatic isocyanate. As the aromatic isocyanate, methylene diphenyl diisocyanate (MDI), toluene diisocyanate (TDI), p-phenylene diisocyanate (PPDI), or naphthalene diisocyanate (NDI) may be used, and as the aliphatic isocyanate, hexamethylene diisocyanate (HDI), isophorone diisocyanate (IPDA), dicyclohexylmethane-4,4'-diisocyanate ($H_{12}$MDI), meth-tetramethylxylene diisocyanate (TMXDI), trans cyclohexane diisocyanate (CHDI) or trimethyl hexamethylene diisocyanate (TMDI). A content of the isocyanate compound may be 10 to 40 wt % with respect to the total weight of a raw material.

As the foaming agent, $CFCl_3$, $CF_2Cl_2$, or water may be used. A content of the foaming agent may be 0.01 to 5 wt % with respect to the total weight of a raw material.

The catalyst serves to catalyze the reaction between polyol and isocyanate or between water and isocyanate. As the catalyst, an amine-based catalyst such as triethylene diamine (TEDA), dimethyl ethanol amine (DMSA), tetramethyl butane diamine (TMBDA), dimethyl cyclohexyl amine (DMCHA) or triethyl amine (TEA); or an organic metal salt such as dibutyl tin dilaurate or stannous octoate may be used. A content of the catalyst may be 0.01 to 5 wt % with respect to the total weight of a raw material.

The foam stabilizer reduces a surface tension of a foam system to enhance miscibility, makes the size of generated bubbles uniform, and controls a cell structure of the foam, thereby providing stability to a foaming body. As the foam stabilizer, a silicone compound may be used. A content of the foam stabilizer may be 0.01 to 5 wt % with respect to the total weight of a raw material.

All raw materials may be mixed together at one time, or divided into two or more streams and sequentially mixed, and then make foams using a molding or foaming machine according to a conventional foaming method.

At least one of the inner container (upper and lower parts) and the impregnating material may contain an antimicrobial component, and preferably, all of the inner container (upper and lower parts) and the impregnating material may contain the antimicrobial component. That is, as the antimicrobial component is contained in the inner container (upper and lower parts) and the impregnating material, the proliferation of microorganisms in the puff and the cosmetic may be inhibited.

The antimicrobial component may be silver glass (CAS No 65997-17-3) containing 1 to 3 wt % of silver. For example, the silver glass containing 1.8 wt % of silver may be used. When the silver glass is used, an antimicrobial ability may be effectively provided to the containers and the impregnating material.

The inner container (upper and lower parts) may contain 1 to 3 wt % of silver glass, and the impregnating material may contain 0.1 to 2 wt % of silver glass. When an amount of the antimicrobial component is too small, a sufficient antimicrobial ability may not be exhibited, and when an amount of the antimicrobial component is too large, other physical properties may be degraded. For example, the inner container (upper and lower parts) may consist of 80 wt % of a raw material and 20 wt % of an antimicrobial masterbatch. Here, the antimicrobial masterbatch may consist of 90 wt % of a raw material and 10 wt % of silver glass, and the silver glass may contain 1.8 wt % of silver. The impregnating material may consist of 99 wt % of a raw material and 1 wt % of silver glass, wherein the silver glass may contain 1.8 wt % of silver. Within the above-described content range, 99.99% or more antimicrobial ability with respect to *S. aureus* and *E. coli* may be ensured.

Figure 7:
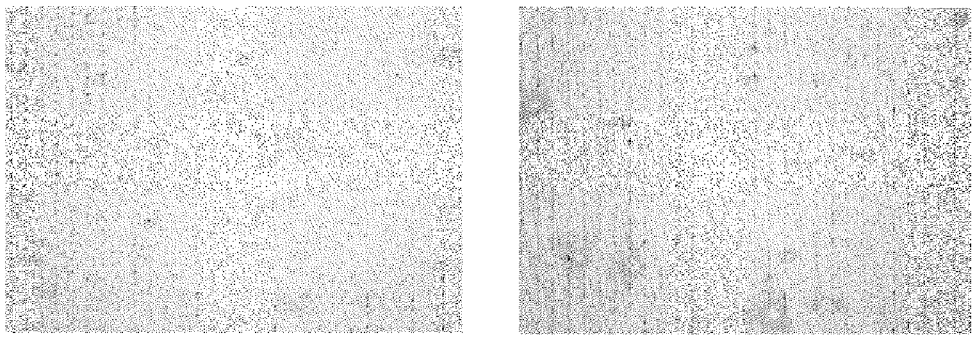
FIG. 7 shows electron micrographs of an upper part of the inner container and a lower part of the inner container, which include an antimicrobial silver glass material.

Table 2 shows the result of an antimicrobial test for the impregnating material, and Table 3 shows the results of an antimicrobial test for the inner container (upper and lower parts) without the impregnating material. FIG. 7 shows electron micrographs of the upper inner container and lower inner container, which include a antimicrobial silver glass material, in which the upper inner container is shown on the left side, and the lower inner container is shown on the right side. The antimicrobial test was performed according to ISO 22196:2007.

TABLE 2

| Strain | Sample Name | Initial number of strain | After 24 hours | Reducing ratio (%) |
|---|---|---|---|---|
| *S. aureus* | Polycaprolactone polyol foam | $2.0 \times 10^5$ | 1< | 99.99 |
| *E. coil* | Polycaprolactone polyol foam | $2.5 \times 10^5$ | $5.2 \times 10^2$ | 99.79 |

TABLE 3

| Strain | Sample Name | Initial number of cells | After 24 hours | Reducing ratio (%) |
|---|---|---|---|---|
| *S. aureus* | Upper part of inner container | $2.0 \times 10^5$ | 1< | 99.99 |
| | Lower part of inner container | | 1< | 99.99 |
| *E. coil* | Upper part of inner container | $2.5 \times 10^5$ | $6.2 \times 10^4$ | 75.20 |
| | Lower part of inner container | | $6.2 \times 10^4$ | 75.20 |

Figure 8:
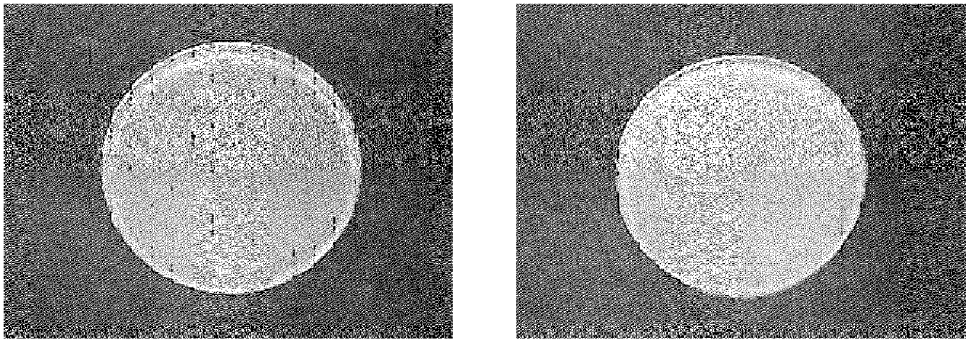
FIG. 8 shows results of an antimicrobial test for *Staphylococcus aureus* (*S. aureus*) in an antimicrobial treatment sample and a non-treatment sample.
Figure 9:
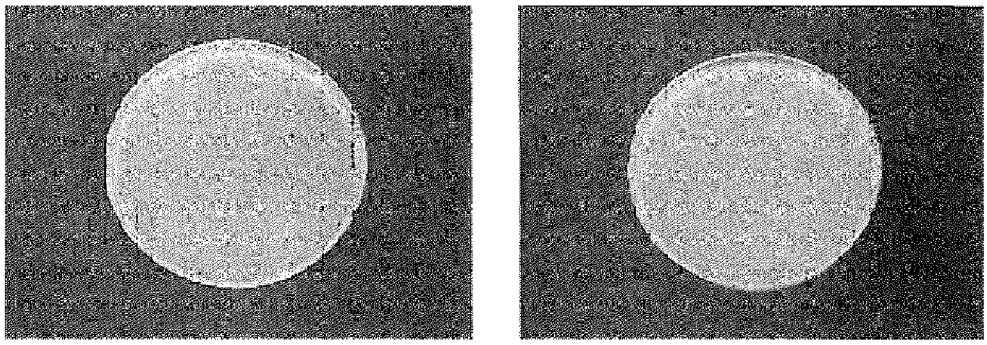
FIG. 9 shows results of an antimicrobial test for *Escherichia coli* (*E. coli*) in an antimicrobial treatment sample and a non-treatment sample.

Table 4 shows the comparative results of the antimicrobial test for the antimicrobial treatment and non-treatment samples (impregnating material+inner container (upper and lower parts)). FIG. 8 shows results of the antimicrobial test for *S. aureus* in the antimicrobial treatment sample and the non-treatment sample: the antimicrobial treatment sample is shown on the left side, and the non-treatment sample is shown on the right side. FIG. 9 shows results of the antimicrobial test for *E. coli* in the antimicrobial treatment sample and the non-treatment sample: the antimicrobial treatment sample is shown on the left side, and the non-treatment sample is shown on the right side.

TABLE 4

| Strain | Sample Name | Initial number of cells | After 24 hours | Reducing ratio (%) |
|---|---|---|---|---|
| *S. aureus* | Antimicrobial treatment (impregnating material + inner container (upper and lower parts)) | 5.32 | <20 | 99.999 |
| | non-treatment (impregnating material + inner container (upper and lower parts)) | | 8.63 | — |
| *E. coil* | Antimicrobial treatment (impregnating material + inner container (upper and lower parts)) | 5.51 | <20 | 99.999 |
| | non-treatment (impregnating material + inner container (upper and lower parts)) | | 8.49 | — |

The cosmetic impregnated in the impregnating material may be, for example, UV-blocking, whitening and wrinkle-reducing cosmetic. The cosmetic composition may be a pact-type UV-blocking, whitening and wrinkle-reducing cosmetic composition, which contains 15 to 55 wt % of an oily component, 1 to 5 wt % of a surfactant, 0.1 to 3 wt % of a thickening agent, 5 to 20 wt % of a UV blocking agent, 5 to 25 wt % of a powder pigment, 1 to 5 wt % of a whitening agent, 0.01 to 2 wt % of a wrinkle-reducing agent and 20 to 50 wt % of an aqueous component with respect to the total weight of the composition.

The oily component may be one or more selected from the group consisting of triglyceride-based oil, ester-based oil, silicone-based oil, and a polymer.

The surfactant may be one or more selected from the group consisting of lauryl PEG-9 polydimethylsiloxyethyl dimethicone, PEG-60 hydrogenated castor oil, PEG-10 dimethicone, sorbitan olivate, octyldodeceth-16, and sorbitan sesquioleate.

The thickening agent may be one or more selected from the group consisting of xanthan gum, trihydroxystearin, dextrin palmitate/ethylhexanoate, silica dimethyl silylate, disteardimonium hectorite, quatemium-18 hectorite, and stearalkonium hectorite.

The UV-blocking agent may be one or more selected from the group consisting of titanium dioxide, zinc oxide, butyl methoxydibenzoylmethane, bis-ethylhexyloxyphenol methoxyphenyl triazine, octyl methoxycinnamate, 4-methylbenzylidene camphor, phenylbenzimidazole sulfonic acid, octyl salicylate, homosalate, octocrylene, and polysilicone-15.

The powder pigment may be one or more selected from the group consisting of triethoxycaprylylsilane-coated iron oxide, polyurethane, an HDI/trimethylol hexyllactone crosspolymer, polymethyl methacrylate, methyl methacrylate crosspolymer, ultramarine, and silica.

The whitening agent may be one or more selected from the group consisting of arbutin, niacinamide, a broussonetia extract, ethyl ascorbyl ether (3-O-ethyl ascorbic acid), an oil-soluble licorice (glycyrrhiza) extract, ascorbyl glucoside, magnesium ascorbyl phosphate, (−)-alpha-bisabolol, and ascorbyl tetraisopalmitate.

The wrinkle-reducing agent may be one or more selected from the group consisting of polyethoxylated retinamide, retinol, retinol palmitate, and adenosine.

The aqueous component may be one or more selected from the group consisting of distilled water, mannan, glycerin, hydrolyzed collagen, pentylene glycol, beta-glucan, dipropylene glycol, and panthenol.

An impregnating material according to the present invention consists of a polycaprolactone polyol foam, thereby having excellent physical properties such as water resistance and oil resistance, and includes an antimicrobial component, thereby inhibiting the proliferation of microorganisms. Also, a container according to the present invention includes an antimicrobial component, and thus can inhibit the proliferation of microorganisms transferred by a puff. In other words, the present invention provides an antimicrobial sealed cosmetic container with an antimicrobial ability and a sealing ability, which contains an impregnating material consisting of a polycaprolactone polyol foam having enhanced water resistance and oil resistance and an antimicrobial ability.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

| [Explanation of Reference Numerals] | |
|---|---|
| 1: upper inner container | 2: ring |
| 3: inner container packing | 4: lower inner container |
| 5: upper outer container | 6: middle outer container |
| 7: lower outer container | 8: button |
| 9: tension | 10: mirror |
| 11, 12: pin | 14: impregnating material (foam) |

What is claimed is:

1. A cosmetic container, comprising:

an outer container;

an inner container contained in the outer container, and composed of an upper part of the inner container and a lower part of the inner container; and an impregnating material contained in the inner container, and consisting of a polycaprolactone polyol foam made of a compound represented by Formula 1,

[Formula 1]

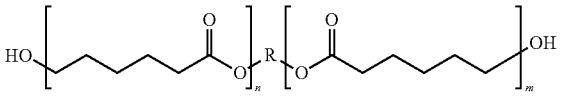

where R is an alkylene or arylene group having 1 to 30 carbon atoms, and n and m are each independently an integer from 1 to 1000;

wherein the upper part of the inner container, the lower part of the inner container and the impregnating material contains an antimicrobial silver glass component, wherein the antimicrobial silver glass component is silver glass containing 1 to 3 wt % of silver, the upper part of the inner container and the lower part of the inner container contain 1 to 3 wt % of the silver glass, and the impregnating material contains 0.1 to 2 wt % of the silver glass.

2. The cosmetic container of claim 1, wherein the compound represented by Formula 1 has a molecular weight of 1000±100, a melting point of 30 to 40° C., a density of 1.05±0.1 g/cm$^3$, and a viscosity of 150±10 mPa·s.

3. The cosmetic container of claim 1, wherein the impregnating material has an open cell structure, and a density of 1.05±0.1 g/cm$^3$, a pore number of 80 to 100 pores per inch (ppi), and a hardness of 40 to 50.

* * * * *